US007545245B2

(12) United States Patent
Zhou et al.

(10) Patent No.: US 7,545,245 B2
(45) Date of Patent: Jun. 9, 2009

(54) MANUAL OPENING DEVICE AND ELECTRICAL SWITCHING APPARATUS EMPLOYING THE SAME

(75) Inventors: Xin Zhou, Franklin Park, PA (US); Brad R. Leccia, Bethel Park, PA (US); Paul J. Rollmann, Brown Deer, WI (US)

(73) Assignee: Eaton Corporation, Cleveland, OH (US)

( * ) Notice: Subject to any disclaimer, the term of this patent is extended or adjusted under 35 U.S.C. 154(b) by 445 days.

(21) Appl. No.: 11/414,941

(22) Filed: May 1, 2006

(65) Prior Publication Data

US 2007/0252667 A1 Nov. 1, 2007

(51) Int. Cl.

| | |
|---|---|
| ***H01H 81/00*** | (2006.01) |
| ***H01H 75/02*** | (2006.01) |
| ***H01H 77/02*** | (2006.01) |
| ***H01H 85/00*** | (2006.01) |
| ***H01H 73/00*** | (2006.01) |

(52) U.S. Cl. ..... 335/27; 335/16; 335/164; 335/173; 335/186; 335/238; 218/118; 218/140; 218/152; 218/119; 218/153; 361/71; 361/72; 361/115; 200/18; 200/329; 200/400

(58) Field of Classification Search ..... 335/16, 335/27, 164, 173, 186, 238; 218/118–120, 218/140, 152–154; 361/71, 72, 115; 200/18, 200/329, 400

See application file for complete search history.

(56) References Cited

U.S. PATENT DOCUMENTS

| | | | | |
|---|---|---|---|---|
| 3,129,358 | A * | 4/1964 | Harbaugh et al. | 361/73 |
| 3,334,202 | A * | 8/1967 | Tognella | 200/82 B |
| 3,590,192 | A | 6/1971 | Bould et al. | |
| 3,750,059 | A | 7/1973 | Patel et al. | |
| 3,794,792 | A * | 2/1974 | Wilson | 200/400 |
| 3,944,772 | A * | 3/1976 | Davies | 200/400 |
| 4,272,687 | A | 6/1981 | Borkan | |
| 4,471,797 | A | 9/1984 | Cass et al. | |
| 4,611,620 | A | 9/1986 | Wang | |
| 4,743,876 | A | 5/1988 | Milianowicz et al. | |
| 5,121,645 | A * | 6/1992 | Agambar et al. | 74/2 |
| 5,652,416 | A | 7/1997 | Sharaf et al. | |
| 5,936,817 | A | 8/1999 | Matsko et al. | |
| 6,242,708 | B1 | 6/2001 | Marchand et al. | |
| 6,285,270 | B1 * | 9/2001 | Lane et al. | 335/6 |
| 6,326,872 | B1 | 12/2001 | Marchand et al. | |
| 6,362,445 | B1 | 3/2002 | Marchand et al. | |
| 6,365,993 | B1 | 4/2002 | Calhoon et al. | |

(Continued)

*Primary Examiner*—Lincoln Donovan
*Assistant Examiner*—Mohamad A Musleh
(74) *Attorney, Agent, or Firm*—Martin J. Moran

(57) ABSTRACT

A manual opening device is for an electrical switching apparatus, such as a synchronous circuit breaker, including a housing having an opening, a plurality of pole mechanisms each comprising separable contacts, and at least one operating mechanism including a number of actuators adapted to open and close the separable contacts. The operating mechanism is supported by the housing and includes a corresponding pole shaft. The manual opening device comprises an operating handle, a cam assembly, and a drive assembly. A first end of the operating handle protrudes through the opening of the housing and the second end is coupled to the cam assembly. The drive assembly couples the cam assembly to the corresponding pole shaft of the operating mechanism and cooperates with the corresponding pole shaft and actuators to simultaneously open the separable contacts when the operating handle is moved from a first position to a second position.

24 Claims, 4 Drawing Sheets

U.S. PATENT DOCUMENTS 6,373,015 B1 4/2002 Marchand et al.
6,373,358 B1 4/2002 Davies et al.
6,770,832 B2 8/2004 Marchand et al.
6,852,939 B2 * 2/2005 Rhein et al. ..... 218/154
6,930,271 B1 8/2005 Palmieri et al.
2004/0179318 A1 * 9/2004 Hashimoto et al. ..... 361/115

* cited by examiner

MANUAL OPENING DEVICE AND ELECTRICAL SWITCHING APPARATUS EMPLOYING THE SAME

CROSS-REFERENCE TO RELATED APPLICATIONS

This application is related to commonly assigned, concurrently filed:

U.S. patent application Ser. No. 11/414,918, filed May 1, 2006, entitled "Circuit Interrupter Including Point-On-Wave Switching Characteristics"; and U.S. patent application Ser. No. 11/414,917, filed May 1, 2006, entitled "Circuit Interrupter Including Manual Selector Selecting Different Point-On-Wave Switching Characteristics".

BACKGROUND OF THE INVENTION

1. Field of the Invention

The invention relates generally to electrical switching apparatus and, more particularly, to a manual opening device for manually opening the separable contacts of electrical switching apparatus, such as, for example, circuit breakers. The invention also relates to electrical switching apparatus employing manual opening devices.

2. Background Information

Electrical switching apparatus, such as circuit breakers, provide protection for electrical systems from electrical fault conditions such as, for example, current overloads, short circuits and abnormal level voltage conditions. Typically, circuit breakers include a spring powered operating mechanism which opens electrical contacts to interrupt the current through the conductors of an electrical system in response to abnormal conditions.

Under normal operation, relatively large circuit breakers, such as, for example, medium voltage circuit breakers for use in electrical power systems operating at about 1,000 volts or more, are typically supplied with secondary power. This powers a motorized charging mechanism of the operating mechanism and enables the separable contacts of the circuit breaker to be opened or closed relatively easily, for example, by manually pushing the button of a controller disposed on the circuit breaker housing, or remotely, through an electrical connection. However, there must also be a mechanism to manually open the separable contacts in the event of an emergency, damage to the circuit breaker itself, a loss of power or other failure, wherein secondary power might not be available.

Circuit breakers have been known to employ an emergency handle which is accessible at the front face of the circuit breaker housing, and which is structured to be manually actuated in order to trip open the separable contacts. See, for example, U.S. Pat. Nos. 6,373,358 and 6,930,271.

Relatively large (e.g., up to about 3,000 pounds or more) break-away forces are commonly associated with the separation (i.e., opening) of the separable contacts of relatively large (e.g., without limitation, medium voltage) circuit breakers. The break-away force is the force (e.g., magnetic force) which must be exceeded in order to open the separable contacts. It is, therefore, desirable to reduce the amount of physical force that must be exerted in order to operate the manual opening device.

This is particularly true for synchronous switchgear, such as, for example, independent pole operated vacuum circuit breakers wherein manually opening the circuit breaker requires overcoming the cumulative combined break-away forces of a number of separate actuators corresponding to the number of circuit breaker poles. More specifically, in a synchronous circuit breaker, the poles of the circuit breaker and the individual operating mechanisms therefor, are operated independently in order to achieve synchronous switching, commonly referred to in the art as point-on-wave switching. However, each individual operating mechanism has its own associated break-away force. Thus, in the event of a loss of power or other failure, the total combined break-away force of all of the separate operating mechanisms must be overcome to open the separable contacts of the synchronous circuit breaker.

It is desirable, therefore, to provide a manual opening device which is suitable for quickly and easily simultaneously opening the separable contacts of synchronous circuit breakers. It is also desirable to provide such a manual opening device which accomplishes the foregoing through use of a single opening device as opposed to requiring separate opening devices for each pole and associated operating mechanism therefor, of the synchronous circuit breaker. It is further desirable that the manual opening device be relatively easy to employ through use of a minimal amount of physical effort.

There is, therefore, room for improvement in electrical switching apparatus, such as for example, synchronous circuit breakers, and in manual opening devices therefor.

SUMMARY OF THE INVENTION

These needs and others are met by embodiments of the invention, which are directed to a manual opening device for opening the separable contacts of a synchronous electrical switching apparatus using a single operating handle. For example, through use of a cam assembly, large break-away forces can be relatively easily overcome, thereby opening the separable contacts of the synchronous electrical switching apparatus while requiring only a minimal amount of physical force to be applied to the single operating handle.

As one aspect of the invention, a manual opening device is provided for an electrical switching apparatus. The electrical switching apparatus includes a housing having an opening and a plurality of pole mechanisms each comprising separable contacts. At least one operating mechanism includes a number of actuators being adapted to open and close the separable contacts of the pole mechanisms. Each operating mechanism is supported by the housing and includes a corresponding pole shaft. The manual opening device comprises: an operating handle including a first end and a second end, the first end of the operating handle being structured to protrude through the opening of the housing; a cam assembly including a pivot and at least one cam coupled to the pivot, the second end of the operating handle being coupled to the pivot; and a drive assembly structured to couple the cam assembly to the corresponding pole shaft of the at least one operating mechanism, and to cooperate with the corresponding pole shaft and the actuators in order to open the separable contacts of the pole mechanisms when the operating handle is moved from a first position to a second position.

The drive assembly may comprise a first protrusion, a second protrusion, a third protrusion, and at least one linking member, wherein the first protrusion, the second protrusion, and the third protrusion are structured to extend from the corresponding pole shaft of the at least one operating mechanism. When the operating handle is disposed in the first position, the first protrusion may generally extend from the corresponding pole shaft toward the pivot and the at least one cam of the cam assembly. The second protrusion may be structured to couple the corresponding pole shaft to a corresponding one of the actuators, and the linking member may be structured to interconnect the third protrusion of the corresponding pole shaft with a corresponding one of the pole mechanisms in order to open and close the separable contacts of the corresponding one of the pole mechanisms when the corresponding pole shaft pivots. The actuators may comprise magnetic actuators each including a magnet, a movable armature coupled to the second protrusion of the corresponding pole shaft, and a corresponding opening spring coupled to the first protrusion of the corresponding pole shaft, wherein the corresponding opening spring biases the first protrusion and the corresponding pole shaft with a first force adapted to open the separable contacts of the corresponding one of the pole mechanisms, wherein the magnet biases the movable armature with a second force adapted to close the separable contacts of the corresponding one of the pole mechanisms, and wherein the second force of the magnet is greater than the first force of the corresponding opening spring until the operating handle of the manual opening device is disposed at or about the second position.

In response to partial movement of the operating handle from the first position toward the second position, the pivot of the cam assembly and the cam(s) coupled to the pivot may rotate, thereby causing the cam(s) to move the first protrusion and the corresponding opening spring coupled to the first protrusion. In response to partial movement of the corresponding opening spring, the first force of the corresponding opening spring may overcome the second force of the magnet, causing the movable armature of the magnetic actuator to move, thereby moving the second protrusion and pivoting the corresponding pole shaft. In response to partial pivoting of the corresponding pole shaft, the third protrusion which extends from the corresponding pole shaft and the at least one linking member coupled to the third protrusion may move, thereby opening the separable contacts of the corresponding one of the pole mechanisms. The at least one drive assembly may further comprise at least one biasing element having a first end and a second end, wherein the first end of the biasing element is coupled to the pivot of the cam assembly, wherein the second end of the biasing element is structured to be coupled to the housing of the electrical switching apparatus, and wherein the biasing element is structured to bias the operating handle toward the first position.

The electrical switching apparatus may comprise a synchronous circuit breaker including a first pole, a second pole, and a third pole. The pole mechanisms may comprise a first vacuum interrupter for the first pole of the synchronous circuit breaker, a second vacuum interrupter for the second pole of the synchronous circuit breaker, and a third vacuum interrupter for the third pole of the synchronous circuit breaker. The actuators may comprise three separate magnetic actuators, each of the magnetic actuators being adapted to open and close the separable contacts of a corresponding one of the first vacuum interrupter, the second vacuum interrupter, and the third vacuum interrupter. The at least one operating mechanism may comprise first, second, and third operating mechanisms including as the corresponding pole shaft, a first pole shaft for the first pole of the synchronous circuit breaker, a second pole shaft for the second pole of the synchronous circuit breaker, and a third pole shaft for the third pole of the synchronous circuit breaker. Each of the first, second, and third operating mechanisms may be structured to independently control one of the magnetic actuators. The manual opening device may be structured to cooperate with the cam assembly, the magnetic actuators, and the first pole shaft, the second pole shaft, and the third pole shaft, in order to simultaneously open all of the separable contacts of the synchronous circuit breaker.

The drive assembly may further comprise a corresponding first protrusion, a corresponding second protrusion, and a corresponding third protrusion for each of the first pole shaft, the second pole shaft, and the third pole shaft. Each of the magnetic actuators may be associated with a corresponding opening spring coupled to the corresponding first protrusion of a corresponding one of the first pole shaft, the second pole shaft, and the third pole shaft. The cam assembly may include three cams wherein, in response to partial movement of the operating handle from the first position to the second position, each of the cams engages and moves the corresponding first protrusion of the corresponding one of the first pole shaft, the second pole shaft, and the third pole shaft, thereby moving the corresponding opening spring and pivoting the corresponding one of the first pole shaft, the second pole shaft, and the third pole shaft. Each of the magnetic actuators may comprise a movable armature coupled to the corresponding second protrusion of the corresponding one of the first pole shaft, the second pole shaft, and the third pole shaft. The at least one linking member may comprise three linking members, and each of the linking members may be coupled at one end to the corresponding third protrusion of the corresponding one of the first pole shaft, the second pole shaft, and the third pole shaft, and at the other end to the corresponding one of the first vacuum interrupter, the second vacuum interrupter, and the third vacuum interrupter.

The operating handle may move from the second position back to the first position independent of the actuators.

As another aspect of the invention, an electrical switching apparatus comprises: a plurality of poles; a housing having an opening; a plurality of pole mechanisms, each of the pole mechanisms comprising separable contacts; at least one operating mechanism supported by the housing and including a corresponding pole shaft and a number of actuators, the actuators being adapted to open and close the separable contacts of the pole mechanisms; and a manual opening device comprising: an operating handle including a first end and a second end, the first end of the operating handle protruding through the opening of the housing, a cam assembly including a pivot and at least one cam coupled to the pivot, the second end of the operating handle being coupled to the pivot, and a drive assembly coupling the cam assembly to the corresponding pole shaft of the at least one operating mechanism and cooperating with the corresponding pole shaft and the actuators in order to open the separable contacts of the pole mechanisms when the operating handle is moved from a first position to a second position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
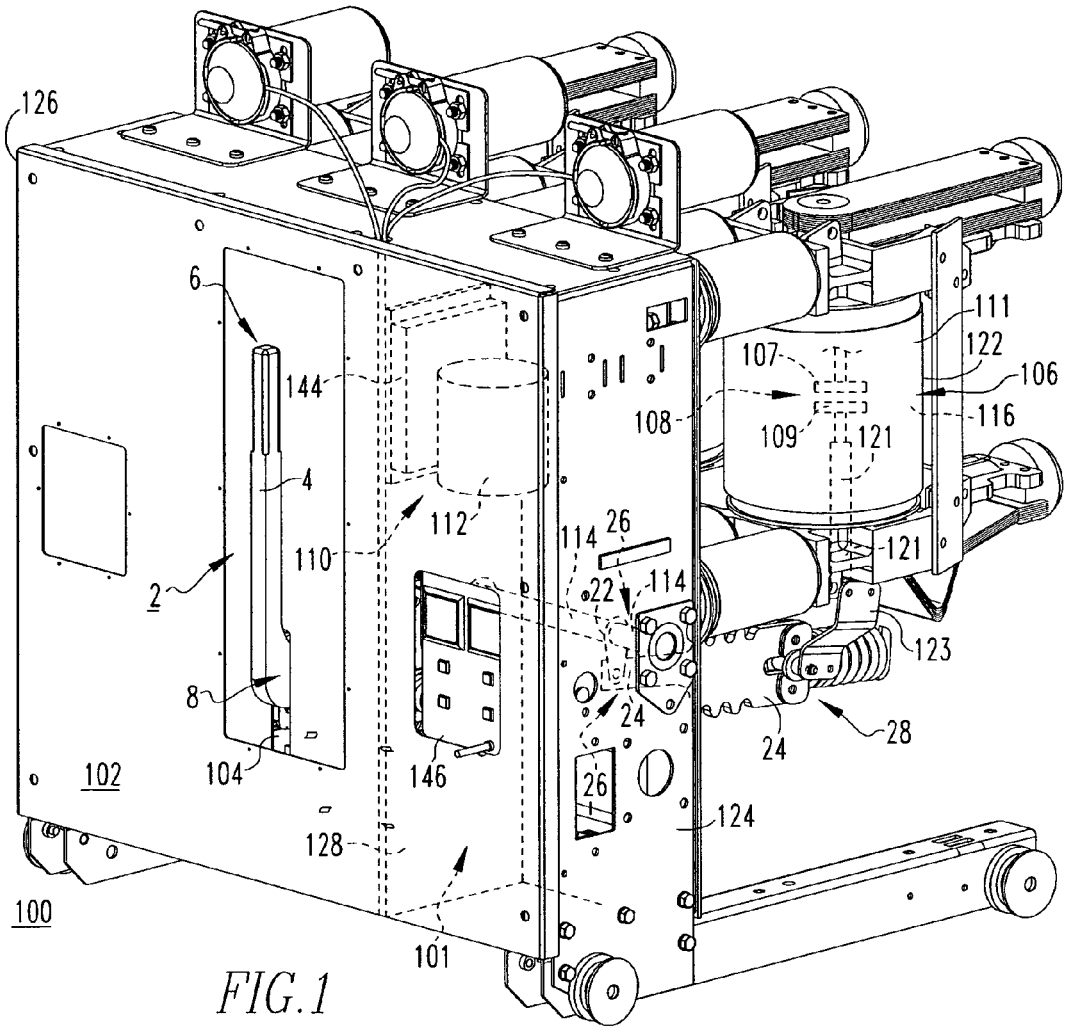
FIG. 1 is an isometric view of the front side of a synchronous circuit breaker and a manual opening device therefor, in accordance with an embodiment of the invention.

For purposes of illustration, the invention will be described as applied to independent pole operated medium voltage vacuum circuit breakers, although it will become apparent that the invention could be applied to manually open a wide variety of other types of electrical switching apparatus (e.g., without limitation, circuit switching devices and other interrupters, such as contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or more than one (i.e., a plurality).

FIG. 1 shows a manual opening device 2 for an electrical switching apparatus 100. In the example of FIG. 1, the electrical switching apparatus is a medium voltage synchronous circuit breaker 100 including a housing 102 having an opening 104, a plurality of pole mechanisms 106 (a single pole mechanism including a vacuum interrupter 111, is shown in FIG. 1) each comprising separable contacts 108 (stationary contact 107 and movable contact 109 are shown in hidden line drawing), and at least one operating mechanism 110 including a number of actuators 112 (one actuator is shown in hidden line drawing). The actuator 112 is adapted to open and close the separable contacts of the corresponding one of the pole mechanisms 106 (e.g., vacuum interrupter 111). The operating mechanism 110 is supported by the housing 102 and includes a corresponding pole shaft 114 (shown in hidden line drawing).

Figure 2:
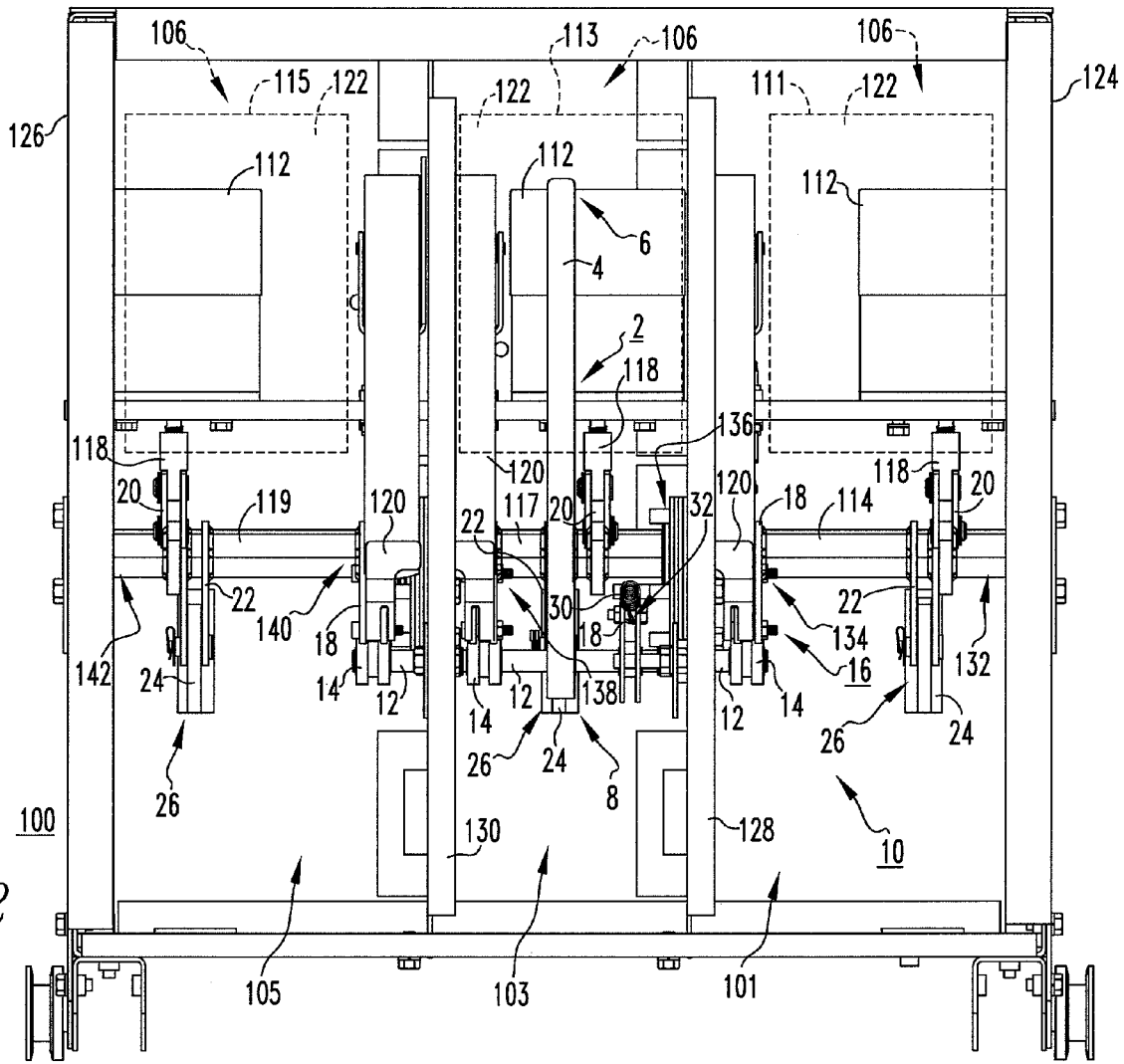
FIG. 2 is a vertical elevational view of the front side of the synchronous circuit breaker and manual opening device of FIG. 1, with the front cover removed to show internal structures.

FIG. 2 shows the synchronous circuit breaker 100 with the front cover of the housing 102 (FIG. 1) removed to show internal structures. The synchronous circuit breaker 100, in the example shown, includes a first pole 101, a second pole 103, and a third pole 105, and the plural pole mechanisms 106. Specifically, the circuit breaker, which is a medium voltage synchronous circuit breaker 100, includes a first vacuum interrupter 111 for the first pole 101, a second vacuum interrupter 113 for the second pole 103, and a third vacuum interrupter 115 for the third pole 105. Each of the vacuum interrupters 111, 113, 115, shown in simplified form in hidden line drawing in FIG. 2, includes an electrically insulative pod 122 (best shown in FIG. 1) which is coupled to the housing 102 of the circuit breaker 100 by any known or suitable fastener or fastening mechanism.

Figure 3:
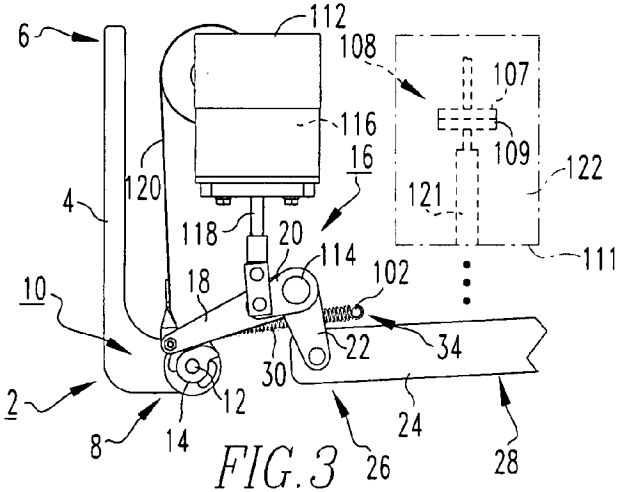
FIG. 3 is a side elevational view of the circuit breaker operating mechanism and manual opening device, showing one of the magnetic actuators and a corresponding pole shaft in their closed positions, with the operating handle in its normal position.
Figure 5:
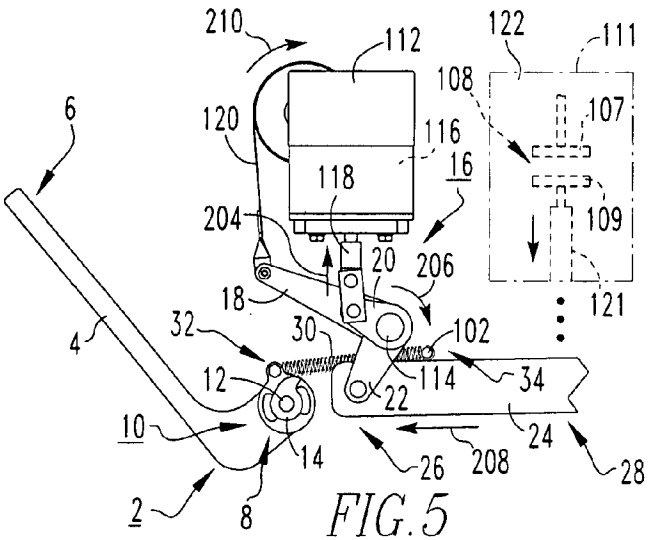
FIG. 5 is a side elevational view of the circuit breaker operating mechanism and manual opening device of FIG. 3, but modified to show the operating handle and the pole shaft pivoted to their open positions, and the magnetic actuator in its open position.

Referring again to FIG. 1, it will be appreciated that the separable contacts 108 of the vacuum interrupter 111 comprise the aforementioned stationary contact 107, and movable contact 109, both of which are disposed within the electrically insulative pod 122, as shown in simplified form in hidden line drawing (see also FIGS. 3 and 5). A movable stem mechanism 121 (shown in simplified form in partially hidden line drawing in FIGS. 1, 3 and 5) extends from inside the insulative pod 122 where it couples to movable contact 109. The movable stem mechanism 121 includes one or more linking element(s) 123 (one linking element 123 is shown in FIG. 1) structured to move the movable contact 109, and thereby open and close the separable contacts 108 when the circuit breaker 100 is opened (FIG. 5) and closed (FIG. 3). A linking member, such as the electrically insulative link 24 shown, includes a first end 26 (shown in hidden line drawing) coupled to the corresponding pole shaft 114 of the circuit breaker operating mechanism 110, and a second end 28 coupled to the movable contact 109 of the vacuum interrupter 111 through the movable stem mechanism 121 and linking element(s) 123 thereof.

As shown in one or more of FIGS. 1-6, the manual opening device 2 includes an operating handle 4 having a first end 6 and a second end 8. The first end 6 protrudes through the opening 104 (FIG. 1) of the circuit breaker housing 102. The second end 8 of the operating handle 4 is coupled to a cam assembly 10 (FIGS. 3-6). Specifically, the cam assembly 10 includes a pivot 12, and at least one cam 14 coupled to the pivot 12. It is the pivot 12 to which the second end 8 of the operating handle 4 is coupled. In the example shown and described herein, a drive assembly 16 couples the cam assembly 10 to corresponding first, second, and third pole shafts 114, 117, 119, and the actuators 112. In this manner, the manual opening device 2 is structured to simultaneously open all of the separable contacts 108 of the pole mechanisms 106 when the operating handle 4 is moved from the first normal position shown in FIG. 3, to the second open position of FIG. 5.

More specifically, the drive assembly 16 comprises a first protrusion 18, a second protrusion 20, a third protrusion 22, and the aforementioned linking member, which is an electrically insulative link 24 made from any known or suitable electrically insulating material (e.g., without limitation, plastic). Thus, in the example shown and described herein, the drive assembly 16 comprises a corresponding first protrusion 18, a corresponding second protrusion 20, and a corresponding third protrusion 22 for each of the first pole shaft 114, the second pole shaft 117, and the third pole shaft 119 of the synchronous circuit breaker 100 (best shown in FIG. 2). The first, second, and third protrusions or lever arms 18, 20, 22 extend generally perpendicularly from the corresponding pole shaft 114, 117, 119. For simplicity of illustration, only first pole shaft 114 and first, second, and third protrusions 18, 20, 22 therefor, are shown in FIGS. 3-6. When the operating handle 4 is disposed in the first position, as shown in FIG. 3, the first protrusion 18 generally extends from the pole shaft 114 toward pivot 12 and cam 14 of the cam assembly 10. The second protrusion 20 couples the pole shaft 114 to the corresponding actuator 112, and the third protrusion 22 couples the pole shaft 114 through the electrically insulative link 24 to the movable contact 109 of the corresponding vacuum interrupter 111, as previously discussed. Thus, as will be discussed in greater detail hereinbelow, when the corresponding pole shaft 114 pivots as a result of the operating handle 4 being moved, the first, second, and third protrusions 18, 20, 22 extending therefrom move, in order to open (FIG. 5) the separable contacts 108 within the vacuum interrupter 111.

In the example which is shown and described herein, the circuit breaker housing 102 includes a first side 124, a second side 126, a first divider 128 between the first and second poles 101, 103 of the circuit breaker 100, and a second divider 130 between the second and third poles 103, 105 of the circuit breaker 100 (best shown in FIG. 2). The first end 132 of the first pole shaft 114 is movably coupled to the first side 124 of housing 102, and the second end 134 is movably coupled to one side of the first divider 128. The first and second ends 136, 138 of the second pole shaft 117 are movably coupled to the other side of the first divider 128 and the first side of the second divider 130, respectively, and the first and second ends 140, 142 of the third pole shaft 119 are movably coupled to the second side at second divider 130 and the second side 126 of circuit breaker housing 102, respectively. In other words, first pole shaft 114 is disposed between the first side 124 of circuit breaker housing 102 and first divider 128, second pole shaft 117 is disposed between the first and second dividers 128, 130, and the third pole shaft 119 is disposed between the second divider 130 and the second side 126 of the circuit breaker housing 102.

Each of the actuators comprises a magnetic actuator 112 including a magnet 116, a movable armature 118 coupled to the second protrusion 20 of the corresponding pole shaft 114, and a corresponding opening spring 120, which is coupled to the first protrusion 18 of the corresponding pole shaft 114. The opening spring 120 biases the first protrusion 18 and the corresponding pole shaft 114 with a first force adapted to open the separable contacts 108 of the corresponding vacuum interrupter 111, and the magnet 116 biases the movable armature 118 with a second force adapted to close the separable contacts 108. The second force of the magnet 116 is greater than the first force of the corresponding opening spring 120 until the operating handle 4 of the manual opening device 2 is disposed at or about the second position. Magnetic actuators, and the structure and operation thereof, are generally old and well known in the art. The exemplary synchronous circuit breaker 100 includes three magnetic actuators 112, one for each of the first, second, and third poles 101, 103, 105 of the breaker 100 with the corresponding opening spring 120 of each of the magnetic actuators 112 being coupled to the corresponding first protrusion 18 of the corresponding first pole shaft 114, second pole shaft 117, or third pole shaft 119, as previously discussed.

The example cam assembly 10 includes three cams 14 wherein, in response to partial movement (FIG. 4) of the operating handle 4 from the first position (FIG. 3) toward the second position (FIG. 5), each of the cams 14 engages and moves a corresponding first protrusion 18 and a corresponding first, second, or third pole shaft 114, 117, 119, from which it extends. This, in turn, moves the corresponding opening spring 120, which is coupled to the corresponding first protrusion 18, resulting in the aforementioned second force of magnet 116 being overcome by the first force of opening spring 120. In other words, once movement of the opening spring 120 is initiated by the cam assembly 10, the breakaway force of magnet 116 is overcome and the first force of opening spring 120 facilitates the pivoting of the pole shafts 114, 117, 119, and ultimately opens the separable contacts 108.

A more detailed discussion of the operation of the exemplary manual opening device 2, for example, in the event of an emergency condition, such as an electrical failure, or other failure, will now be discussed in connection with FIGS. 3-6. FIG. 3 shows the operating handle 4 of the manual opening device 2 in the first or normal position. As shown, when the operating handle 4 is in the first position, the separable contacts 108 within vacuum interrupter 111 are closed. The vacuum interrupter 111, and components thereof, are shown in simplified form, for simplicity of illustration, with the stationary and movable contacts 107, 109 being shown in hidden line drawing. Before the manual opening device 2 is actuated, the magnetic actuator 112 and movable armature 118 and corresponding open spring 120 thereof, are in their first positions corresponding to the separable contacts 108 being closed, as shown. More specifically, and as previously discussed, in the position shown, the second or hold down force of magnet 116 of the magnetic actuator 112 is greater than the opening force of corresponding open spring 120. Additionally, the cam 14 and pivot 12 of cam assembly 10, to which the second end 8 of the operating handle 4 is coupled, have not pivoted. As such, the first, second, and third protrusions or lever arms 18, 20, 22, of corresponding pole shaft 114, from which they extend, have not been engaged and, therefore, have not moved.

Figure 4:
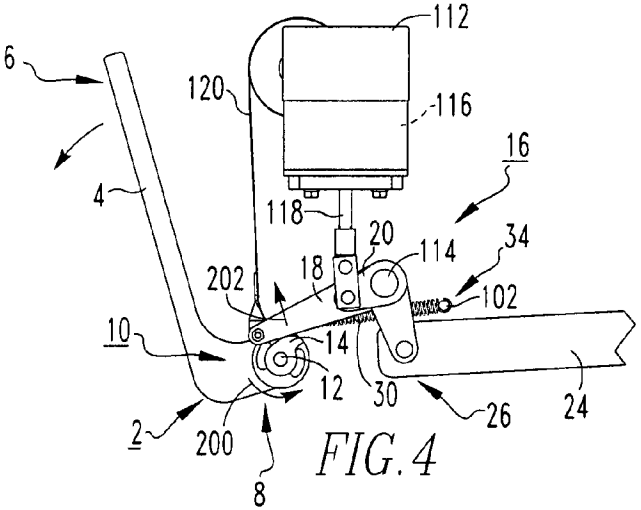
FIG. 4 is a side elevational view of the circuit breaker operating mechanism and manual opening device of FIG. 3, but modified to show the operating handle and the pole shaft partially pivoted to initiate opening of the separable contacts of the circuit breaker, with the magnetic actuator shown in its closed position.

As shown in FIG. 4, in response to partial movement of the operating handle 4 in the counterclockwise direction (from the perspective of FIG. 4) from the first position toward the second position, the pivot 12 of the cam assembly 10, and the cam 14 coupled thereto, rotate counterclockwise in the direction indicated by arrow 200. This causes the cam 14 to engage and move the first protrusion 18 and the corresponding opening spring 120 coupled thereto, and the corresponding movable armature 118, in the direction indicated by arrow 202.

Referring to FIG. 5, in response to partial movement of the corresponding opening spring 120, the first force of the opening spring 120 overcomes the second force of magnet 116 due to the significant decrease in the second force which results upon movement of movable armature 118, as previously discussed. This, in turn, causes the movable armature 118 of the magnetic actuator 112 to move in the direction indicated by arrow 204. Associated with this movement, is the movement of the second protrusion 20 and pivoting of the corresponding pole shaft 114 in the clockwise direction indicated by arrow 206. Finally, in response to partial pivoting of the corresponding pole shaft 114, the third protrusion 22 which extends therefrom, and the electrically insulative link 24 coupled to a third protrusion 22 move in the direction indicated by arrow 208, thereby opening the separable contacts 108 of the corresponding vacuum interrupter 111. More specifically, the movable contact 109, which is coupled to second end 28 of insulative link 24 through movable stem mechanism 121 (FIG. 1) and linking element(s) 123 (FIG. 1), is moved slightly downward (from the perspective of FIG. 5) and separated from stationary contact 107 within the electrically insulative pod 122, as shown.

Figure 6:
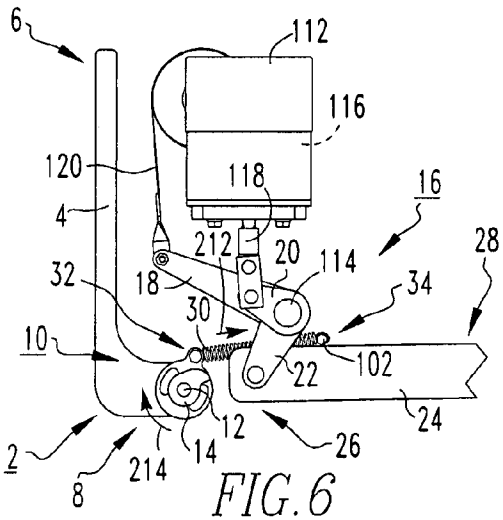
FIG. 6 is a side elevational view of the circuit breaker operating mechanism and manual opening device of FIG. 3, showing the operating handle having returned to the normal position, and the pole shaft and the magnetic actuator in their open positions.

In FIG. 6, the operating handle 4 of the manual opening device 2 has moved from the second position (FIG. 5), back to the first position (FIGS. 3 and 6). It will be appreciated, that such movement, preferably occurs independent of the actuator 112. More specifically, the actuator 112 and, in particular, the movable armature 118 and opening spring 120 thereof, as well as the components of the drive assembly 16 of the manual opening device 2, have not moved from the aforementioned positions shown and described with respect to FIG. 5. Accordingly, the separable contacts 108 remain in the open position, as shown in FIG. 5. Among other advantages, the fact that the operating handle 4 returns to its first position independent with respect to the actuator 112, eliminates the potential for undesirable feedback to the user, when operating the operating handle 4. More specifically, as previously discussed, the magnet 116 of magnetic actuator 112 has a substantial magnetic force associated with it. Accordingly, if the operating handle 4 was not independently operable with respect to actuator 112, the potential would exist for the magnet 116 to cause the separable contacts 108 (FIG. 5) to rapidly close or slam together, thereby pulling the operating handle 4 toward the first position with an undesirable correspondingly high amount of speed and force. In contrast, as will be discussed, the biasing element 30 returns the operating handle 4 of the manual opening device 2 from the second position of FIG. 5, back to the first position of FIG. 6, independent of the actuator 112 and thus, avoids this undesirable scenario.

More specifically, continuing to refer to FIGS. 3-6, drive assembly 16 further comprises at least one biasing element, such as the spring 30 which is shown. The biasing element 30 biases the operating handle 4 toward the first position of FIGS. 3 and 6. Specifically, the biasing element 30 has a first end 32 coupled to the pivot 12 of cam assembly 10, and a second end 34 coupled to a portion of the circuit breaker housing 102, such as a molded post. In this manner, the biasing element 30 biases the corresponding pole shaft 114 clockwise in the direction indicated by arrow 214 (FIG. 6), and the cam assembly 10 and operating handle 4 coupled thereto in the direction indicated by arrow 212 (FIG. 6), from the second position of FIG. 5, toward the first position shown in FIG. 6.

The manual opening device 2 and, in particular, the cam assembly 10 thereof, advantageously permits all of the separable contacts 108 of the synchronous circuit breaker 100 to be opened simultaneously through a minimal exertion of physical force on the operating handle 4. More specifically, the synchronous circuit breaker 100 is an independent pole operated circuit breaker, meaning that the first, second, and third poles 101, 103, 105 of the circuit breaker 100 are independently operated by first, second, and third operating mechanisms 110, respectively. Under normal operation, the first, second, and third operating mechanisms 110 synchronously open and close the separable contacts 108 of the first, second, and third poles 101, 103, 105. As shown in FIG. 1, the operating mechanisms 110 of the independent pole operated circuit breaker 100 include emergency condition (EMCON) controllers 144 (shown in hidden line drawing) to provide the desired electrical signals to the associated magnetic actuators 112 for opening and closing the magnetic actuators 112, and thus the separable contacts 108 of the corresponding circuit breaker first, second and third poles 101, 103, 105. In the example of FIG. 1, the circuit breaker 100 further includes a point-on-wave (POW) controller 146, which controls the three EMCON controllers 144 (one EMCON controller 144 is shown in FIG. 1), in order to provide the desired synchronous operation of the circuit breaker poles 101, 103, 105. It will, however, be appreciated that any other known or suitable number, type, and configuration of controllers could be alternatively employed. The manual opening device 2 cooperates with the first, second, and third operating mechanisms 110 and, in particular, with the cam assembly 10, the magnetic actuators 112, and the corresponding first, second, and third pole shafts 114, 117, 119, in order to simultaneously open all of the separable contacts 108 when the operating handle 4 is moved from the first position (FIG. 3) to the second position (FIG. 5). Thus, when operation of the controllers 144, 146 is not available, the manual opening device 2 can be employed to open the separable contacts 108.

Accordingly, the cam assembly 10 enables a user to quickly and easily overcome the combined break-away forces of all three magnetic actuators 112 of the synchronous circuit breaker 100 by pulling a single operating handle 4, and applying a minimal amount of physical force thereto. More specifically, a cam assembly (e.g., 10) using principals of mechanical advantage, is employed to engage and move the first protrusion or lever arm 18 in the direction indicated by arrow 202 of FIG. 4, which initiates movement of opening spring 120, all of which occurs through application of a minimal (e.g., about 20 pounds) of physical force. As a result, the first force of opening spring 120 facilitates the opening of the separable contacts 108.

Figure 7:
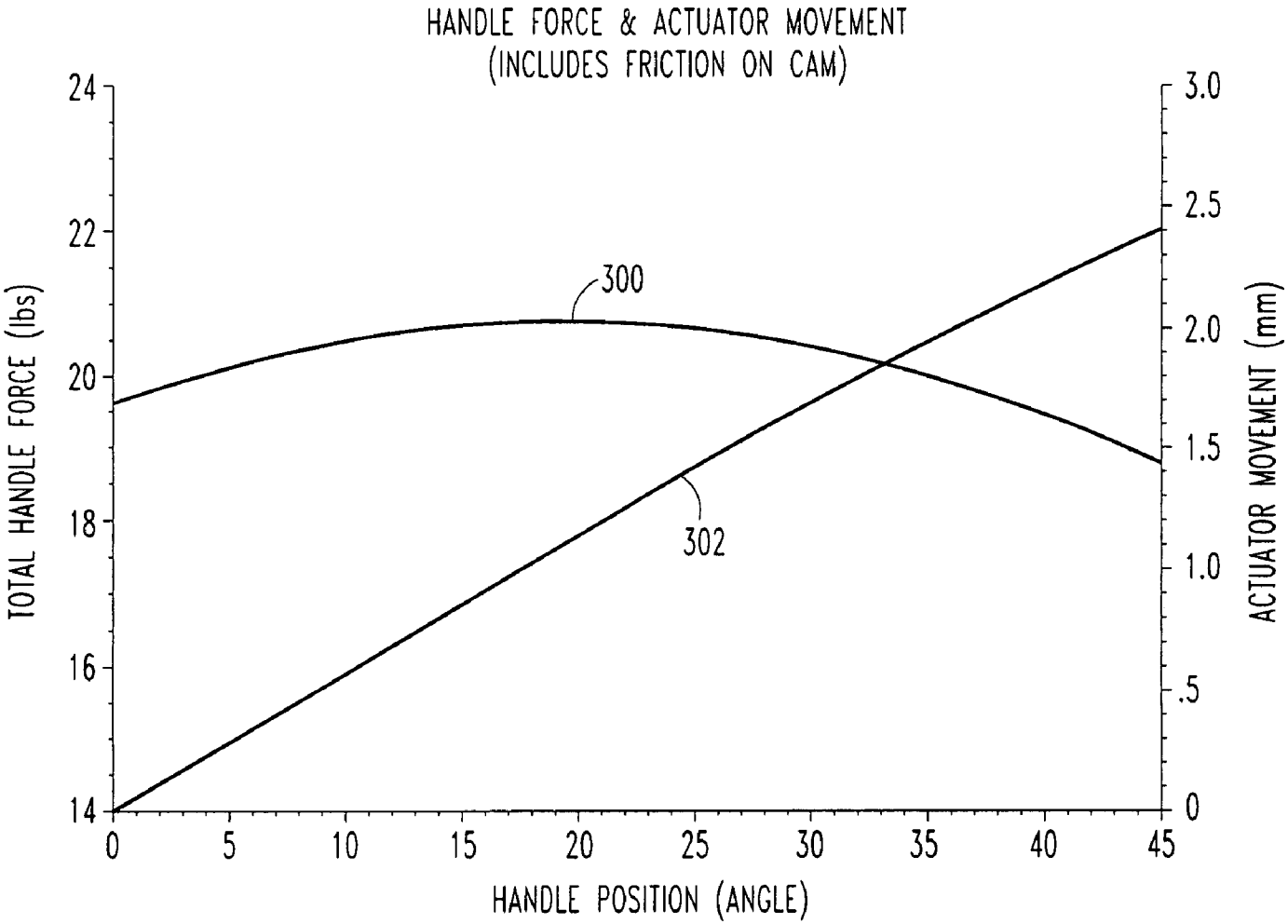
FIG. 7 is a plot showing the force, in pounds, on the operating handle of the manual opening device, and the movement, in millimeters, of the magnetic actuator versus the position (i.e., angle) of the operating handle, when manually opening the synchronous circuit breaker of FIG. 1.

FIG. 7 provides a plot of the operating handle force, in pounds, and actuator movement, in millimeters, versus the operating handle position (i.e., in this example, the angle of the operating handle 4). The plot confirms the minimal (e.g., about 20 pounds) amount of physical force which is employed to manually open the synchronous circuit breaker 100. Specifically, plot line 300 demonstrates the total handle force, in pounds, including friction on the cam 14 (FIGS. 1-6) of cam assembly 10 (FIGS. 1-6), versus the angle of the operating handle 4 (best shown in FIGS. 3-6). As the plot line 300 shows, when the operating handle 4 is disposed in the first position of FIG. 3, an initial force of just above about 19.5 pounds of pressure applied by the user to the operating handle 4 initiates movement of the manual opening device 2. As the operating handle position (i.e., in this example, angle) increases, the total force applied to the operating handle 4 gradually increases to about 20.5 pounds, when the operating handle 4 is approximately 20 degrees from the vertical position (with respect to FIGS. 3 and 4). The force then gradually decreases as cam 14 rotates through its engagement with first protrusion 18, and the operating handle 4 pivots fully to the second position of FIG. 5.

Plot line 302 of FIG. 7 shows the amount of movement, in millimeters, of the actuator 112 corresponding to the position of the operating handle 4. As shown, the relationship is a linear one, with the actuator and, in particular, the movable armature 118 (FIGS. 1-6) thereof, moving from 0 millimeters when the operating handle 4 is in the first position of FIG. 3, to about 2.4 millimeters when the operating handle 4 is in the second position of FIG. 5. Accordingly, the disclosed manual opening device 2 is capable of quickly and easily overcoming a combined brake-away force of up to about 3,000 pounds or more, through a user-applied force of just over 20 pounds to a single operating handle 4. In this manner, even relatively large synchronous circuit breakers (e.g., without limitation, medium voltage independent pole operated circuit breaker 100) can be easily opened in the event of an emergency, or a loss of power or other failure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A manual opening device for an electrical switching apparatus, said electrical switching apparatus including a housing having an opening, a plurality of pole mechanisms each comprising separable contacts, at least one operating mechanism including a number of actuators, said actuators being adapted to open and close said separable contacts of said pole mechanisms, said at least one operating mechanism being supported by said housing and including a corresponding pole shaft, said manual opening device comprising:

an operating handle including a first end and a second end, the first end of said operating handle being structured to protrude through the opening of said housing;

a cam assembly including a pivot and at least one cam coupled to said pivot, the second end of said operating handle being coupled to said pivot separately from said at least one cam; and a drive assembly structured to couple said cam assembly to said corresponding pole shaft of said at least one operating mechanism, and to cooperate with said corresponding pole shaft and said actuators in order to open said separable contacts of said pole mechanisms when said operating handle is moved from a first position to a second position.

2. The manual opening device of claim 1 wherein said drive assembly comprises a first protrusion, a second protrusion, a third protrusion, and at least one linking member; wherein said first protrusion, said second protrusion, and said third protrusion are structured to extend from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion is structured to couple said corresponding pole shaft to a corresponding one of said actuators; and wherein said at least one linking member is structured to interconnect said third protrusion of said corresponding pole shaft with a corresponding one of said pole mechanisms in order to open and close said separable contacts of said corresponding one of said pole mechanisms when said corresponding pole shaft pivots.

3. A manual opening device for an electrical switching apparatus, said electrical switching apparatus including a housing having an opening, a plurality of pole mechanisms each comprising separable contacts, at least one operating mechanism including a number of actuators, said actuators being adapted to open and close said separable contacts of said pole mechanisms, said at least one operating mechanism being supported by said housing and including a corresponding pole shaft, said manual opening device comprising:

an operating handle including a first end and a second end, the first end of said operating handle being structured to protrude through the opening of said housing;

a cam assembly including a pivot and at least one cam coupled to said pivot, the second end of said operating handle being coupled to said pivot; and a drive assembly structured to couple said cam assembly to said corresponding pole shaft of said at least one operating mechanism, and to cooperate with said corresponding pole shaft and said actuators in order to open said separable contacts of said pole mechanisms when said operating handle is moved from a first position to a second position, wherein said drive assembly comprises a first protrusion, a second protrusion, a third protrusion, and at least one linking member; wherein said first protrusion, said second protrusion, and said third protrusion are structured to extend from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion is structured to couple said corresponding pole shaft to a corresponding one of said actuators; and wherein said at least one linking member is structured to interconnect said third protrusion of said corresponding pole shaft with a corresponding one of said pole mechanisms in order to open and close said separable contacts of said corresponding one of said pole mechanisms when said corresponding pole shaft pivots, and wherein said corresponding one of said actuators comprises a magnetic actuator including a magnet, a movable armature coupled to said second protrusion of said corresponding pole shaft, and a corresponding opening spring coupled to said first protrusion of said corresponding pole shaft; wherein said corresponding opening spring biases said first protrusion and said corresponding pole shaft with a first force adapted to open said separable contacts of said corresponding one of said pole mechanisms; wherein said magnet biases said movable armature with a second force adapted to close said separable contacts of said corresponding one of said pole mechanisms; and wherein the second force of said magnet is greater than the first force of said corresponding opening spring until said operating handle of said manual opening device is disposed at or about said second position.

4. The manual opening device of claim 3 wherein, in response to partial movement of said operating handle from said first position toward said second position, said pivot of said cam assembly and said at least one cam coupled to said pivot rotate, thereby causing said at least one cam to move said first protrusion and said corresponding opening spring coupled to said first protrusion; wherein, in response to partial movement of said corresponding opening spring, the first force of said corresponding opening spring overcomes the second force of said magnet, causing said movable armature of said magnetic actuator to move, thereby moving said second protrusion and pivoting said corresponding pole shaft; and wherein, in response to partial pivoting of said corresponding pole shaft, said third protrusion which extends from said corresponding pole shaft and said at least one linking member coupled to said third protrusion move, thereby opening said separable contacts of said corresponding one of said pole mechanisms.

5. A manual opening device for an electrical switching apparatus, said electrical switching apparatus including a housing having an opening, a plurality of pole mechanisms each comprising separable contacts, at least one operating mechanism including a number of actuators, said actuators being adapted to open and close said separable contacts of said pole mechanisms, said at least one operating mechanism being supported by said housing and including a corresponding pole shaft, said manual opening device comprising:

an operating handle including a first end and a second end, the first end of said operating handle being structured to protrude through the opening of said housing;

a cam assembly including a pivot and at least one cam coupled to said pivot, the second end of said operating handle being coupled to said pivot; and a drive assembly structured to couple said cam assembly to said corresponding pole shaft of said at least one operating mechanism, and to cooperate with said corresponding pole shaft and said actuators in order to open said separable contacts of said pole mechanisms when said operating handle is moved from a first position to a second position, wherein said drive assembly comprises a first protrusion, a second protrusion, a third protrusion, and at least one linking member; wherein said first protrusion, said second protrusion, and said third protrusion are structured to extend from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion is structured to couple said corresponding pole shaft to a corresponding one of said actuators; and wherein said at least one linking member is structured to interconnect said third protrusion of said corresponding pole shaft with a corresponding one of said pole mechanisms in order to open and close said separable contacts of said corresponding one of said pole mechanisms when said corresponding pole shaft pivots, and wherein said at least one drive assembly further comprises at least one biasing element having a first end and a second end; wherein the first end of said biasing element is coupled to said pivot of said cam assembly; wherein the second end of said biasing element is structured to be coupled to said housing of said electrical switching apparatus; and wherein said biasing element is structured to bias said operating handle toward said first position.

6. The manual opening device of claim 2 wherein said corresponding one of said pole mechanisms comprises a vacuum interrupter; wherein said vacuum interrupter includes an electrically insulative pod coupled to said housing of said electrical switching apparatus; wherein said corresponding separable contacts of said vacuum interrupter comprise a stationary contact and a movable contact; wherein said at least one linking member comprises an electrically insulative link having a first end and a second end; wherein the first end of said electrically insulative link is coupled to said third protrusion of said corresponding pole shaft; and wherein the second end of said electrically insulative link is coupled to said movable contact of said vacuum interrupter.

7. The manual opening device of claim 2 wherein said first protrusion, said second protrusion, and said third protrusion comprise first, second, and third lever arms, respectively; and wherein said first, second, and third lever arms each extend generally perpendicularly from said corresponding pole shaft of said at least one operating mechanism.

8. The manual opening device of claim 2 wherein said electrical switching apparatus comprises a synchronous circuit breaker including a first pole, a second pole, and a third pole; wherein said pole mechanisms comprise a first vacuum interrupter for the first pole of said synchronous circuit breaker, a second vacuum interrupter for the second pole of said synchronous circuit breaker, and a third vacuum interrupter for the third pole of said synchronous circuit breaker; wherein said actuators comprise three separate magnetic actuators, each of said magnetic actuators being adapted to open and close said separable contacts of a corresponding one of said first vacuum interrupter, said second vacuum interrupter, and said third vacuum interrupter; wherein said at least one operating mechanism comprises first, second, and third operating mechanisms including as said corresponding pole shaft, a first pole shaft for the first pole of said synchronous circuit breaker, a second pole shaft for the second pole of said synchronous circuit breaker, and a third pole shaft for the third pole of said synchronous circuit breaker; wherein each of said first, second, and third operating mechanisms is structured to independently control one of said magnetic actuators; and wherein said manual opening device is structured to cooperate with said cam assembly, said magnetic actuators, and said first pole shaft, said second pole shaft, and said third pole shaft, in order to simultaneously open all of said separable contacts of said synchronous circuit breaker.

9. The manual opening device of claim 8 wherein said drive assembly further comprises a corresponding first protrusion, a corresponding second protrusion, and a corresponding third protrusion for each of said first pole shaft, said second pole shaft, and said third pole shaft; wherein each of said magnetic actuators is associated with a corresponding opening spring coupled to said corresponding first protrusion of a corresponding one of said first pole shaft, said second pole shaft, and said third pole shaft; wherein said cam assembly includes as said at least one cam, three cams; and wherein, in response to partial movement of said operating handle from said first position to said second position, each of said cams engages and moves said corresponding first protrusion of said corresponding one of said first pole shaft, said second pole shaft, and said third pole shaft, thereby moving said corresponding opening spring and pivoting said corresponding one of said first pole shaft, said second pole shaft, and said third pole shaft.

10. A manual opening device for an electrical switching apparatus, said electrical switching apparatus including a housing having an opening, a plurality of pole mechanisms each comprising separable contacts, at least one operating mechanism including a number of actuators, said actuators being adapted to open and close said separable contacts of said pole mechanisms, said at least one operating mechanism being supported by said housing and including a corresponding pole shaft, said manual opening device comprising:

an operating handle including a first end and a second end, the first end of said operating handle being structured to protrude through the opening of said housing;

a cam assembly including a pivot and at least one cam coupled to said pivot, the second end of said operating handle being coupled to said pivot; and a drive assembly structured to couple said cam assembly to said corresponding pole shaft of said at least one operating mechanism, and to cooperate with said corresponding pole shaft and said actuators in order to open said separable contacts of said pole mechanisms when said operating handle is moved from a first position to a second position, wherein said drive assembly comprises a first protrusion, a second protrusion, a third protrusion, and at least one linking member; wherein said first protrusion, said second protrusion, and said third protrusion are structured to extend from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion is structured to couple said corresponding pole shaft to a corresponding one of said actuators; and wherein said at least one linking member is structured to interconnect said third protrusion of said corresponding pole shaft with a corresponding one of said pole mechanisms in order to open and close said separable contacts of said corresponding one of said pole mechanisms when said corresponding pole shaft pivots, wherein said electrical switching apparatus comprises a synchronous circuit breaker including a first pole, a second pole, and a third pole; wherein said pole mechanisms comprise a first vacuum interrupter for the first pole of said synchronous circuit breaker, a second vacuum interrupter for the second pole of said synchronous circuit breaker, and a third vacuum interrupter for the third pole of said synchronous circuit breaker; wherein said actuators comprise three separate magnetic actuators, each of said magnetic actuators being adapted to open and close said separable contacts of a corresponding one of said first vacuum interrupter, said second vacuum interrupter, and said third vacuum interrupter; wherein said at least one operating mechanism comprises first, second, and third operating mechanisms including as said corresponding pole shaft, a first pole shaft for the first pole of said synchronous circuit breaker, a second pole shaft for the second pole of said synchronous circuit breaker, and a third pole shaft for the third pole of said synchronous circuit breaker; wherein each of said first, second, and third operating mechanisms is structured to independently control one of said magnetic actuators; and wherein said manual opening device is structured to cooperate with said cam assembly, said magnetic actuators, and said first pole shaft, said second pole shaft, and said third pole shaft, in order to simultaneously open all of said separable contacts of said synchronous circuit breaker, wherein said drive assembly further comprises a corresponding first protrusion, a corresponding second protrusion, and a corresponding third protrusion for each of said first pole shaft, said second pole shaft, and said third pole shaft; wherein each of said magnetic actuators is associated with a corresponding opening spring coupled to said corresponding first protrusion of a corresponding one of said first pole shaft, said second pole shaft, and said third pole shaft; wherein said cam assembly includes as said at least one cam, three cams; and wherein, in response to partial movement of said operating handle from said first position to said second position, each of said cams engages and moves said corresponding first protrusion of said corresponding one of said first pole shaft, said second pole shaft, and said third pole shaft, thereby moving said corresponding opening spring and pivoting said corresponding one of said first pole shaft, said second pole shaft, and said third pole shaft, and wherein each of said magnetic actuators comprises a movable armature coupled to said corresponding second protrusion of said corresponding one of said first pole shaft, said second pole shaft, and said third pole shaft; wherein said at least one linking member comprises three linking members; and wherein each of said linking members is coupled at one end to said corresponding third protrusion of said corresponding one of said first pole shaft, said second pole shaft, and said third pole shaft, and at the other end to said corresponding one of said first vacuum interrupter, said second vacuum interrupter, and said third vacuum interrupter.

11. The manual opening device of claim 1 wherein said operating handle moves from said second position back to said first position independent of said actuators.

12. An electrical switching apparatus comprising:

a plurality of poles;

a housing having an opening;

a plurality of pole mechanisms, each of said pole mechanisms comprising separable contacts;

at least one operating mechanism supported by said housing and including a corresponding pole shaft and a number of actuators, said actuators being adapted to open and close the separable contacts of said pole mechanisms; and a manual opening device comprising:

an operating handle including a first end and a second end, the first end of said operating handle protruding through the opening of said housing, a cam assembly including a pivot and at least one cam coupled to said pivot, the second end of said operating handle being coupled to said pivot separately from said at least one cam, and a drive assembly coupling said cam assembly to said corresponding pole shaft of said at least one operating mechanism and cooperating with said corresponding pole shaft and said actuators in order to open said separable contacts of said pole mechanisms when said operating handle is moved from a first position to a second position.

13. The electrical switching apparatus of claim 12 wherein said drive assembly comprises a first protrusion, a second protrusion, a third protrusion, and at least one linking member; wherein said first protrusion, said second protrusion, and said third protrusion extend generally perpendicularly from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion couples said corresponding pole shaft to a corresponding one of said actuators; and wherein said at least one linking member interconnects said third protrusion of said corresponding pole shaft with a corresponding one of said pole mechanisms in order to open and close said separable contacts of said corresponding one of said pole mechanisms when said corresponding pole shaft pivots.

14. An electrical switching apparatus comprising:

a plurality of poles;

a housing having an opening;

a plurality of pole mechanisms, each of said pole mechanisms comprising separable contacts;

at least one operating mechanism supported by said housing and including a corresponding pole shaft and a number of actuators, said actuators being adapted to open and close the separable contacts of said pole mechanisms; and a manual opening device comprising:

an operating handle including a first end and a second end, the first end of said operating handle protruding through the opening of said housing, a cam assembly including a pivot and at least one cam coupled to said pivot, the second end of said operating handle being coupled to said pivot, and a drive assembly coupling said cam assembly to said corresponding pole shaft of said at least one operating mechanism and cooperating with said corresponding pole shaft and said actuators in order to open said separable contacts of said pole mechanisms when said operating handle is moved from a first position to a second position, wherein said drive assembly comprises a first protrusion, a second protrusion, a third protrusion, and at least one linking member; wherein said first protrusion, said second protrusion, and said third protrusion extend generally perpendicularly from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion couples said corresponding pole shaft to a corresponding one of said actuators; and wherein said at least one linking member interconnects said third protrusion of said corresponding pole shaft with a corresponding one of said pole mechanisms in order to open and close said separable contacts of said corresponding one of said pole mechanisms when said corresponding pole shaft pivots, and wherein said corresponding one of said actuators comprises a magnetic actuator including a magnet, a movable armature coupled to said second protrusion of said corresponding pole shaft, and a corresponding opening spring coupled to said first protrusion of said corresponding pole shaft; wherein said corresponding opening spring biases said first protrusion and said corresponding pole shaft with a first force adapted to open said separable contacts of said corresponding one of said pole mechanisms; wherein said magnet biases said movable armature with a second force adapted to close said separable contacts of said corresponding one of said pole mechanisms; and wherein the second force of said magnet is greater than the first force of said corresponding opening spring until said operating handle of said manual opening device is disposed at or about said second position.

15. The electrical switching apparatus of claim 14 wherein, in response to partial movement of said operating handle from said first position toward said second position, said pivot of said cam assembly and said at least one cam coupled to said pivot rotate, thereby causing said at least one cam to move said first protrusion and said corresponding opening spring coupled to said first protrusion; wherein, in response to partial movement of said corresponding opening spring, the first force of said corresponding opening spring overcomes the second force of said magnet, causing said movable armature of said magnetic actuator to move, thereby moving said second protrusion and pivoting said corresponding pole shaft; and wherein, in response to partial pivoting of said corresponding pole shaft, said third protrusion which extends from said corresponding pole shaft and said at least one linking member coupled to said third protrusion move, thereby opening said separable contacts of said corresponding one of said pole mechanisms.

16. An electrical switching apparatus comprising:

a plurality of poles;

a housing having an opening;

a plurality of pole mechanisms, each of said pole mechanisms comprising separable contacts;

at least one operating mechanism supported by said housing and including a corresponding pole shaft and a number of actuators, said actuators being adapted to open and close the separable contacts of said pole mechanisms; and a manual opening device comprising:

an operating handle including a first end and a second end, the first end of said operating handle protruding through the opening of said housing, a cam assembly including a pivot and at least one cam coupled to said pivot, the second end of said operating handle being coupled to said pivot, and a drive assembly coupling said cam assembly to said corresponding pole shaft of said at least one operating mechanism and cooperating with said corresponding pole shaft and said actuators in order to open said separable contacts of said pole mechanisms when said operating handle is moved from a first position to a second position, wherein said drive assembly comprises a first protrusion, a second protrusion, a third protrusion, and at least one linking member; wherein said first protrusion, said second protrusion, and said third protrusion extend generally perpendicularly from said corresponding pole shaft of said at least one operating mechanism; wherein, when said operating handle is disposed in said first position, said first protrusion generally extends from said corresponding pole shaft toward said pivot and said at least one cam of said cam assembly; wherein said second protrusion couples said corresponding pole shaft to a corresponding one of said actuators; and wherein said at least one linking member interconnects said third protrusion of said corresponding pole shaft with a corresponding one of said pole mechanisms in order to open and close said separable contacts of said corresponding one of said pole mechanisms when said corresponding pole shaft pivots, and wherein said at least one drive assembly further comprises at least one biasing element having a first end and a second end; wherein the first end of said biasing element is coupled to said pivot of said cam assembly; wherein the second end of said biasing element is coupled to said housing of said electrical switching apparatus; and wherein said biasing element biases said operating handle toward said first position.

17. The electrical switching apparatus of claim 13 wherein said corresponding one of said pole mechanisms comprises a vacuum interrupter; wherein said vacuum interrupter includes an electrically insulative pod coupled to said housing of said electrical switching apparatus; wherein said corresponding separable contacts of said vacuum interrupter comprise a stationary contact and a movable contact; wherein said at least one linking member comprises an electrically insulative link having a first end and a second end; wherein the first end of said electrically insulative link is coupled to said third protrusion of said corresponding pole shaft; and wherein the second end of said electrically insulative link is coupled to said movable contact of said vacuum interrupter.

18. The electrical switching apparatus of claim 13 wherein said first protrusion, said second protrusion, and said third protrusion comprise first, second, and third lever arms, respectively; and wherein said first, second, and third lever arms each extend generally perpendicularly from said corresponding pole shaft of said at least one operating mechanism.

19. The electrical switching apparatus of claim 13 wherein said electrical switching apparatus includes as said poles, a first pole, a second pole, and a third pole; wherein said pole mechanisms comprise a first vacuum interrupter for the first pole of said electrical switching apparatus, a second vacuum interrupter for the second pole of said electrical switching apparatus, and a third vacuum interrupter for the third pole of said electrical switching apparatus; wherein said actuators comprise three separate magnetic actuators, each of said magnetic actuators being adapted to open and close said separable contacts of a corresponding one of said first vacuum interrupter, said second vacuum interrupter, and said third vacuum interrupter; wherein said at least one operating mechanism comprises first, second, and third operating mechanisms including as said corresponding pole shaft, a first pole shaft for said first pole, a second pole shaft for said second pole, and a third pole shaft for said third pole; wherein each of said first, second, and third operating mechanisms independently controls one of said magnetic actuators; and wherein said manual opening device cooperates with said cam assembly, said magnetic actuators, and said first pole shaft, said second pole shaft, and said third pole shaft, in order to simultaneously open all of said separable contacts of said electrical switching apparatus.

20. The electrical switching apparatus of claim 19 wherein said drive assembly further comprises a corresponding first protrusion, a corresponding second protrusion, and a corresponding third protrusion for each of said first pole shaft, said second pole shaft, and said third pole shaft; wherein each of said magnetic actuators is associated with a corresponding opening spring coupled to said corresponding first protrusion of a corresponding one of said first pole shaft, said second pole shaft, and said third pole shaft; wherein said cam assembly includes as said at least one cam, three cams; and wherein, in response to partial movement of said operating handle from said first position to said second position, each of said cams engages and moves said corresponding first protrusion of said corresponding one of said first pole shaft, said second pole shaft, and said third pole shaft, thereby moving said corresponding opening spring and pivoting said corresponding one of said first pole shaft, said second pole shaft, and said third pole shaft.

21. The electrical switching apparatus of claim 20 wherein each of said magnetic actuators comprises a movable armature coupled to said corresponding second protrusion of said corresponding one of said first pole shaft, said second pole shaft, and said third pole shaft; wherein said at least one linking member comprises three linking members; and wherein each of said linking members is coupled at one end to said corresponding third protrusion of said corresponding one of said first pole shaft, said second pole shaft, and said third pole shaft, and at the other end to said corresponding one of said first vacuum interrupter, said second vacuum interrupter, and said third vacuum interrupter.

22. The electrical switching apparatus of claim 19 wherein said housing of said electrical switching apparatus comprises a first side, a second side, and a number of dividers; wherein said dividers comprise a first divider disposed between said first pole of said electrical switching apparatus and said second pole of said electrical switching apparatus, and a second divider disposed between said second pole of said electrical switching apparatus and said third pole of said electrical switching apparatus; wherein said first pole shaft, said second pole shaft, and said third pole shaft each include a corresponding first end and a corresponding second end; wherein said first pole shaft is disposed between said first side of said housing and said first divider; wherein the corresponding first end of said first pole shaft pivotally engages said first side of said housing and the corresponding second end of said first pole shaft pivotally engages said first divider; wherein said second pole shaft is disposed between said first divider and said second divider; wherein the corresponding first end of said second pole shaft pivotally engages said first divider and the corresponding second end of said second pole shaft pivotally engages the second divider; wherein said third pole shaft is disposed between said second divider and said second side of said housing; and wherein the corresponding first end of said third pole shaft pivotally engages said second divider and the corresponding second end of said third pole shaft pivotally engages said second side of said housing.

23. The electrical switching apparatus of claim 19 wherein said electrical switching apparatus is an independent pole operated circuit breaker; and wherein said first pole, said second pole, and said third pole of said independent pole operated circuit breaker are independently operated by said first, second, and third operating mechanisms, respectively.

24. The electrical switching apparatus of claim 23 wherein, under normal operation, said first, second, and third operating mechanisms of said independent pole operated circuit breaker synchronously open and close said separable contacts of said first pole, said separable contacts of said second pole, and said separable contacts of said third pole; and wherein said manual opening device cooperates with said first, second, and third operating mechanisms in order to simultaneously open all of said separable contacts of said independent pole operated circuit breaker.

* * * * *